United States Patent [19]

Shaw

[11] 4,237,647

[45] Dec. 9, 1980

[54] SOFT TOY CONTAINING SOUNDING DEVICE

[76] Inventor: Maurice Shaw, 27, Greenway Close, Totteridge, London, England

[21] Appl. No.: 2,579

[22] Filed: Jan. 11, 1979

[30] Foreign Application Priority Data

Jan. 13, 1978 [GB] United Kingdom ..... 1445/78

[51] Int. Cl.[3] ..... A63H 5/00

[52] U.S. Cl. ..... 46/117; 46/232; 46/227

[58] Field of Search ..... 46/117, 232, 227, 228; 3/1.1

[56] References Cited

U.S. PATENT DOCUMENTS

| | | | |
|---|---|---|---|
| 844,577 | 2/1907 | Borchardt | 46/228 |
| 3,190,038 | 6/1965 | Kardon | 46/117 X |
| 3,232,004 | 2/1966 | Felsher | 46/232 X |
| 3,418,661 | 12/1968 | Allison et al. | 3/1.1 |
| 3,621,356 | 11/1971 | Kwan | 46/256 UX |

*Primary Examiner*—Robert Peshock
*Assistant Examiner*—Mickey Yu
*Attorney, Agent, or Firm*—B. P. Fishburne, Jr.

[57] ABSTRACT

A soft toy having a greater degree of appeal than normal soft toys. The toy, which may for example be a teddy bear, panda, or other animal, has two electric contacts disposed at spaced-apart regions of the exterior of the toy, there being contained within the toy an electrically operated device for producing a noise, such as a musical tune, when the contacts are bridged by being touched by a child or other user.

6 Claims, 2 Drawing Figures

SOFT TOY CONTAINING SOUNDING DEVICE

BACKGROUND OF THE INVENTION

The invention relates to a soft toy having a degree of appeal greater than normal soft toys.

Soft toys, such as teddy bears, pandas, and representations of other animals are of interest to small children: Frequently, however, the interest which a child has in a soft toy, rapidly fades.

SUMMARY OF THE INVENTION

It is an object of this invention to provide a soft toy of a nature such as to be of enduring interest for a child. According to the present invention there is provided a soft toy having two electric contacts disposed at spaced-apart regions on the exterior of the toy, an electrically operable noise producing device disposed within the toy, input terminals on said device, and conductors connecting said input terminals to said electrical contacts, said noise producing device comprising electronic switching means having an "on" condition and an "off" condition, said switching device being in its "on" condition whenever said electric contacts are resistively bridged by being touched simultaneously by a user of the toy, said device further comprising a noise producing apparatus which is operated whenever said switching means is in the "on" condition.

BRIEF DESCRIPTION OF THE DRAWINGS

There follows a detailed description of the preferred embodiment to be read together with the accompanying drawings which are provided solely for the purpose of illustration.

DETAILED DESCRIPTION OF THE PREFERRED EMBODIMENT

Figure 1:
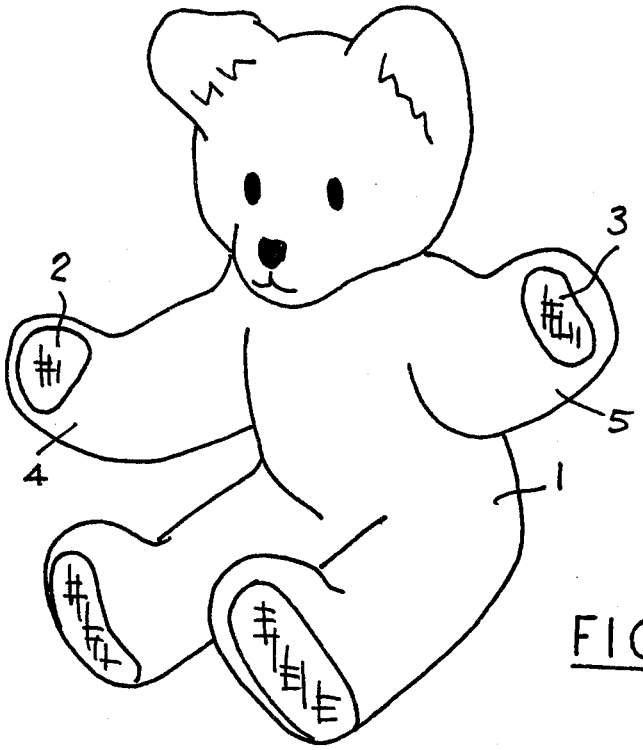
FIG. 1 is a perspective view of a soft toy constructed in accordance with the invention.

FIG. 1 shows a soft toy in the form of a teddy bear 1. At the paw regions of the arms 3 and 4 of the bear, electric contacts 2 and 3 are provided. These contacts may be of metal, metal mesh, graphite impregnated fabric or any other appropriate conductor, the electric resistance of the contact material being uncritical, within a range of from zero up to several thousand ohms.

Figure 2:
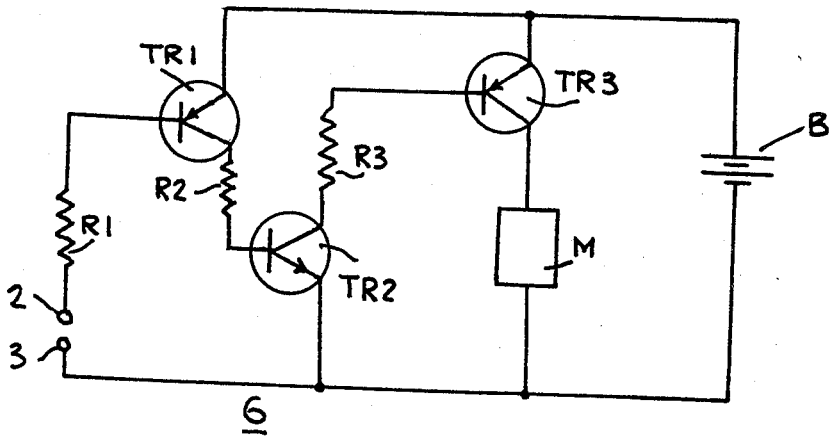
FIG. 2 is a circuit diagram of a device which is contained within the toy and which actuates a musical tune producing mechanism.

Contained within the bear 1, is an electrically operated device, the circuit diagram of which is shown in FIG. 2. The terminals 2 and 3 shown in FIG. 2 are the contacts 2 and 3 of the FIG. 1.

The electrically operated device, indicated generally in FIG. 2 by reference numeral 6, is a transistorised switching device for operating an electric motor M.

In the embodiment, the motor M is used to drive a music-box mechanism and such music-box mechanisms are commercially available already comprising a suitable battery-operated motor.

In the device 6 of FIG. 2, a transistor TR1 obtains its base current through a resistor R1, which is included for safety purposes and protects the transistor in the event of the contacts 2 and 3 being touched directly together. When a person, for example a child, bridges the contacts 2 and 3, a small current flows through resistor R1.

Resistor R1 typically has a resistance of 2000 ohms. The current flowing through resistor R1 is amplified by transistor TR1 and provides a much higher current through a resistor R2, thus biasing a transistor TR2 to its on or conducting state.

The resistance of resistor R2 is chosen so that even when transistor TR1 is switched fully on, the base current of transistor TR2 is limited to a safe value. When transistor TR2 conducts fully, a sufficiently high base current flows through a resistor R3 to bias a power transistor TR3 to its on state and to provide sufficient collector current in this transistor TR3 to operate the motor M or other load. Resistor R3 typically has a resistance of 120 ohms.

The device 6 is energized by a battery B. A switch (not shown) may be provided for isolating the battery from the circuit, but when the contacts 2 and 3 are not bridged, the stand-by current taken from the battery by the device is so small as to make the provision of a switch unnecessary.

The motor M preferably is a motor of a motor-driven music-box mechanism. Thus, when the contacts 2 and 3 are bridged, the music-box mechanism produces a musical tune, to the delight of the child playing with the toy.

The device 6 may be constructed on a printed circuit board.

Instead of using an electric motor M, a solenoid can be used which actuates a pawl-mechanism, for example, which allows a clockwork music-box mechanism to operate.

Instead of a music-box mechanism, an electronic tune generator may be provided, using an appropriately programmed ROM device.

Instead of a musical tune producing means, a device arranged to produce a single note may be provided, although that has less appeal for a child.

In addition to the production of a noise or a musical tune, the device 6 may be arranged to operate an electric lamp or lamps, either constantly, or in a flashing mode. For example, the eyes of the toy may light up. Alternatively, a solenoid arrangement may be provided so that the eyes of the toy move.

To enable sound produced in the interior of the toy to be effectively heard, a perforated grille may be provided in the body of the toy, although such a grille is not necessary.

One or more contacts additional to the contacts 2 and 3, and electrically connected thereto, may be provided so that the toy can be caused to operate not only by bridging the contacts 2 and 3. For example, in addition to the contacts 2 and 3, a contact electrically connected to the contact 3 may be provided at the back of the toy, so that if a child holds the paw 4 of the bear 1 with his left hand and places his right hand on the back of the bear, in dancing-fashion, the music-box mechanism will operate.

The device will operate even if a considerable resistance exists between the contacts 2 and 3. Thus a child can touch the contact 2 with one hand and the contact 3 with the other hand and cause the device to operate. Even a chain of people holding hands can cause the device to operate if the contact 2 is touched by a person at one end of the chain and the contact 3 is touched at the same time by the person at the other end of the chain.

It will be appreciated that the current flowing in the base circuit of transistor TR1 is so small that it is not felt by the person bridging the contacts 2 and 3 ad can not cause any harm.

The circuit 6 given in FIG. 2 is only one possible configuration of a suitable circuit. The invention lies in the incorporation of a touch-triggerable sound producing device in a soft toy. Thus, other means for operating a sound producing device may be used, for example devices in which an oscillator is put into or out of an oscillatory condition when the contacts are bridged, or devices using proximity effects, so that the actual galvanic contact bridging is not necessary.

Although the invention has been described in terms of a teddy bear, it is applicable to any soft toy.

In one form, the invention may be embodied in a baby walker. In such a case, the electric contacts would be provided on a handle or other part of the baby walker which is gripped by a child (or parent) when using the baby walker. Proper gripping of the handle causes the noise, for example musical tune, to be produced, and the child can then propel the baby walker along, for example on wheels.

When the toy is of a kind having arms, such as in the case with a teddy bear, it is of particular benefit in connection with handicapped children, because the children learn to associate the reward of the musical tune with holding hands with the toy. This encourages handicapped children to use their hands and arms, and also gives them confidence. Moreover, since the toy can be caused to produce a musical tune if the contacts are bridged by the two ends of a chain of people each holding hands, many games can be devised which are of benefit to handicapped children, in encouraging them to participate in group activities.

I claim:

1. A soft toy havig two electric contacts disposed at spaced-apart regions on the exterior of the toy, an electrically operable noise producing device disposed within the toy, input terminals on said device, and conductors connecting said input terminals to said electric contacts, said noise producing device comprising electronic switching means having an "on" condition and an "off" condition, said switching means being in its "on" condition whenever said electric contacts are resistively bridged by being touched simultaneously by a user of the toy, said device further comprising a noise producing apparatus which is operated whenever said switching means is in the "on" condition.

2. A toy according to claim 1, wherein the said apparatus includes an electric motor and a music box mechanism driven by said motor.

3. A toy according to claim 1, wherein said apparatus comprises an electric motor and a record playing device driven by said motor.

4. A toy according to claim 1, wherein said apparatus comprises an electronic tune generating module.

5. A toy according to claim 1, and comprising at least one light source operated simultaneously with the noise producing device.

6. A toy according to claim 5, and comprising means for intermittently flashing said light source.

* * * * *